US007849520B2

(12) United States Patent
Blenkarn

(10) Patent No.: US 7,849,520 B2
(45) Date of Patent: Dec. 14, 2010

(54) LAMINATED COLLAR AND A GARMENT HAVING SUCH LAMINATED COLLAR

(75) Inventor: Michael Douglas Blenkarn, North Vancouver (CA)

(73) Assignee: Arc'Teryx Equipment Inc., North Vancouver, British Columbia (BC) (CA)

( * ) Notice: Subject to any disclaimer, the term of this patent is extended or adjusted under 35 U.S.C. 154(b) by 282 days.

(21) Appl. No.: 11/355,012

(22) Filed: Feb. 16, 2006

(65) Prior Publication Data

US 2007/0118961 A1 May 31, 2007

(30) Foreign Application Priority Data

Nov. 29, 2005 (EP) ..... 05025939

(51) Int. Cl.
*A41B 3/00* (2006.01)
*A41D 3/08* (2006.01)

(52) U.S. Cl. ..... 2/129; 2/84

(58) Field of Classification Search ..... 2/46, 2/60, 116, 117, 127, 129, 131, 132, 133, 2/134, 135, 139, 142, 143, 202, 84, 128, 2/275, 98

See application file for complete search history.

(56) References Cited

U.S. PATENT DOCUMENTS 1,097,530 A * 5/1914 Cabelinsky ..... 2/84
1,233,860 A * 7/1917 Finkelstein ..... 2/131
1,331,413 A * 2/1920 Buell ..... 2/122
1,388,056 A * 8/1921 North ..... 2/60
2,102,251 A * 12/1937 Arst ..... 2/84
2,152,093 A * 3/1939 Rubinstein ..... 2/131
2,182,582 A * 12/1939 Cohen ..... 2/60
2,345,764 A * 4/1944 May ..... 2/116
2,514,646 A * 7/1950 Johnson ..... 2/60
2,601,046 A * 6/1952 McDonald ..... 2/90
2,612,644 A * 10/1952 Less ..... 2/131
2,633,576 A * 4/1953 Powers et al. ..... 2/60
2,634,420 A * 4/1953 Jackson ..... 2/60
2,637,034 A * 5/1953 Smith ..... 2/60
3,022,514 A * 2/1962 Kaiser ..... 2/60
3,333,280 A * 8/1967 Hynek et al. ..... 2/143
3,363,263 A * 1/1968 Blue ..... 2/116
3,421,159 A * 1/1969 Stebley ..... 2/116
3,486,170 A * 12/1969 Rochon ..... 2/129
3,629,866 A * 12/1971 Blue ..... 2/132
3,698,014 A * 10/1972 Little et al. ..... 2/84
3,725,954 A * 4/1973 Baldini ..... 2/143
3,882,549 A * 5/1975 Gaburo ..... 2/244
4,008,494 A * 2/1977 Hicks ..... 2/60
4,040,125 A * 8/1977 Blue ..... 2/139
4,190,903 A * 3/1980 Kinsella ..... 2/60
4,320,538 A * 3/1982 Saft ..... 2/102
4,324,004 A * 4/1982 Smith et al. ..... 2/131

(Continued)

FOREIGN PATENT DOCUMENTS

DE 202 18 185 U1 7/2003

(Continued)

*Primary Examiner*—Alissa L Hoey
(74) *Attorney, Agent, or Firm*—Greenblum & Bernstein, P.L.C.

(57) ABSTRACT

A garment and a collar for such garment, the collar having a lower zone and an upper zone, the lower zone having a greater rigidity than the upper zone.

26 Claims, 6 Drawing Sheets

U.S. PATENT DOCUMENTS 4,333,980 A * 6/1982 Russell ..... 428/192
4,375,107 A * 3/1983 Bachtiger ..... 2/131
4,434,512 A * 3/1984 Hansen ..... 2/129
4,571,745 A * 2/1986 Albert ..... 2/139
4,653,119 A * 3/1987 Kaiser ..... 2/60
4,670,908 A * 6/1987 Albert ..... 2/139
4,953,232 A * 9/1990 Gaines et al. ..... 2/60
4,989,269 A * 2/1991 Takasugi ..... 2/116
5,115,517 A * 5/1992 Ferguson et al. ..... 2/203
5,182,812 A * 2/1993 Goldsby ..... 2/79
5,230,100 A * 7/1993 Lock-Jones ..... 2/50
5,369,809 A * 12/1994 Hall ..... 2/202
5,711,030 A * 1/1998 Anderson et al. ..... 2/60
5,775,394 A * 7/1998 Wong ..... 112/441
5,782,191 A * 7/1998 Wong ..... 112/441
5,898,941 A * 5/1999 Groshens ..... 2/129
5,940,882 A * 8/1999 Auguste ..... 2/60
6,070,542 A * 6/2000 Wong ..... 112/475.09
6,105,166 A * 8/2000 Thomas et al. ..... 2/60
6,112,329 A * 9/2000 Freiherr von Korff ..... 2/115
6,164,227 A * 12/2000 Itoh ..... 112/475.06
6,250,116 B1 * 6/2001 Groshens ..... 66/171
6,490,735 B2 * 12/2002 Rindle ..... 2/98
6,654,963 B2 12/2003 Fayle et al.
6,836,901 B2 * 1/2005 Hippensteel ..... 2/60
6,907,618 B2 * 6/2005 Rausch et al. ..... 2/82
7,069,598 B1 * 7/2006 Welch ..... 2/129
7,146,647 B2 * 12/2006 Krause et al. ..... 2/129
7,302,710 B2 * 12/2007 Thomas et al. ..... 2/84
2002/0120974 A1 * 9/2002 Krause et al. ..... 2/129
2003/0093850 A1 * 5/2003 Peterkin ..... 2/60
2004/0148678 A1 * 8/2004 Spears ..... 2/129
2006/0143796 A1 * 7/2006 Bugarin ..... 2/202

FOREIGN PATENT DOCUMENTS

EP 1790242 A1 * 5/2007
FR 1 333 171 A 7/1963

* cited by examiner

Fig: 3
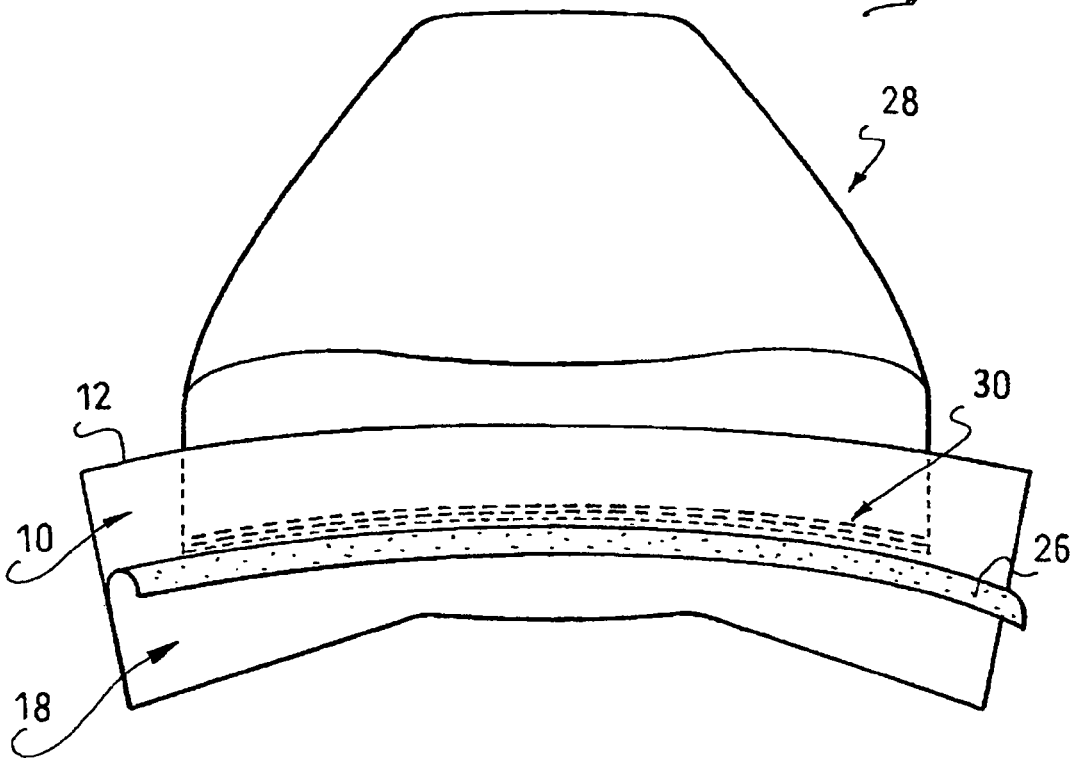
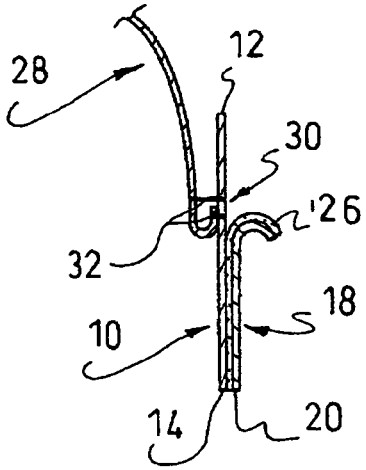
Fig: 4

Fig: 9
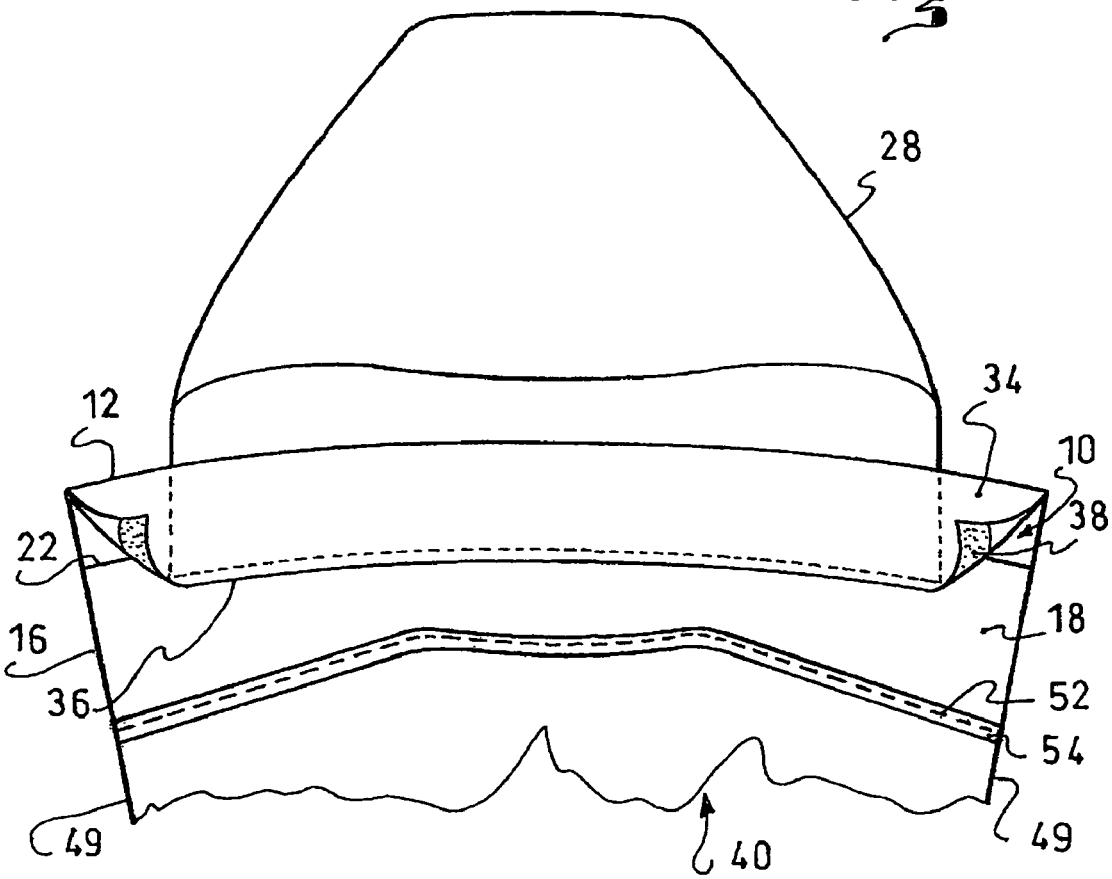
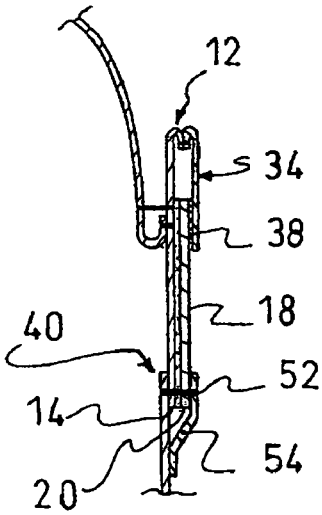
Fig: 10

LAMINATED COLLAR AND A GARMENT HAVING SUCH LAMINATED COLLAR

CROSS-REFERENCE TO RELATED APPLICATION

This application is based upon European Patent Application No. 05025939, filed on Nov. 29, 2005, the disclosure of which is hereby incorporated by reference thereto in its entirety and the priority of which is hereby claimed under 35 USC §119.

BACKGROUND OF THE INVENTION

1. Field of the Invention

The invention relates to a collar for a garment and to a hood and collar assembly for a garment, as well as to a garment incorporating such collar or such hood-collar assembly.

More particularly, the invention is directed to a collar, a hood-collar assembly, and a garment incorporating such collar or hood-collar assembly, particularly in the case in which the garment is an outerwear garment such as a jacket. The invention is further directed to weather protection garments such as water-proof, water-resistant, and/or rain-resistant garments, as well as wind-proof or wind resistant garments, for which advantages of the collar and of the hood-collar assembly according to the invention are particularly important when incorporated therein.

2. Description of Background and Relevant Information

Garments of the aforementioned type most often use fabrics showing at least a certain degree of water repellency and, more particularly, at least a certain degree of imperviousness to liquid water. On the other hand, it is advantageous to use fabrics which, while being resistant to the ingression of liquid water (such as rain) from the outside towards the inside of the garment, allow water vapour to escape from the inside toward the outside of the garment. Such fabrics are known as breathable water-resistant fabrics.

When designing such protective garments, it is desirable to achieve a lightweight and compact construction, without compromising either the performance (especially in terms of protection) or the durability or the comfort of the garment. It is also desirable to seek an aesthetically pleasing construction, the details of which shall remain the least visible. Another significant aspect is that the cost of the construction shall remain acceptable.

Collars, especially collars for jackets, are usually made of at least an outer collar layer and an inner collar layer, each made of one or several fabric panels, and which are stitched together along their peripheries. When a hood is attached to the collar, it is frequently attached to the outer collar layer, along a connecting zone which is positioned between a top edge and a bottom edge of the layer, and at a distance from both edges.

An example of a jacket with such a type of hood-collar assembly is described in the commonly assigned U.S. Pat. No. 6,654,963, the disclosure of which is hereby incorporated by reference thereto in its entirety.

In such a construction, each of the inner and outer layers of the collar is free to move relative to the other along their entire facing area, except at their peripheral edges. Especially, they can move away from each other along a direction perpendicular to their respective general planes. This means that, in use, especially the inner layer can exhibit an irregular inner surface with localized bumps or wrinkles. These bumps and wrinkles tend to come very frequently into contact with the user's neck or with other apparel items worn by the user under the jacket. Such frequent contact can be a source of discomfort and can cause rapid wear of the inner layer. Moreover, since the collar is basically attached only to the outer panel, the weight of the hood and every movement of the hood can cause a distortion of the outer layer which is usually made of relatively flexible material. Here again, durability and comfort may be hindered by such construction.

SUMMARY OF THE INVENTION

It is therefore an object of the invention to provide an improved collar and an improved hood-collar assembly, which is easy to assemble, aesthetically attractive, comfortable, and durable.

In view of these objects, the invention provides for a collar for a garment, wherein the collar has an outer layer and an inner layer facing each other along a facing area, the facing area comprising a lower facing zone and an upper facing zone, or a proximal facing zone and a distal facing zone, with the outer and inner layers being connected one to another by adhesive bonding along at least a substantial portion of the lower/proximal facing zone, and, wherein, along the upper/distal facing zone, the inner and outer layers are free relative to each other except along the periphery of the upper/distal facing zone.

According to another object of the invention, a hood-collar assembly for a garment is provided, comprising: an outer collar layer having a top edge and a bottom edge; an external surface and an internal surface; a hood connected to the external surface of the outer layer along a connecting zone which is positioned between the top edge end the bottom edge, at a distance from both edges; an inner layer comprising at least a first inner collar layer having a top edge and a bottom edge, the first inner collar panel covering at least a lower part of the outer collar layer, the first inner collar panel being adhesively bonded to the internal surface of the outer collar layer along a substantial part of an adhesion zone, and the adhesion zone covering the connecting zone of the hood.

According to still another object of the invention, a collar is provided for a garment, with the collar having a lower zone and an upper zone, or proximal and distal zones, the lower zone having a greater rigidity than the upper zone, and the lower zone possibly having a connecting zone for connecting a hood.

According to still another object, the invention provides for a garment such as an outerwear garment, that a collar or hood-collar assembly according to the foregoing objects.

BRIEF DESCRIPTION OF THE DRAWINGS

Other aspects of the invention will be set forth in the following detailed specification which refers to the appended drawings in which:

FIGS. 3 and 4 and FIGS. 5 and 6 are views similar to those of FIGS. 1 and 2, respectively, showing subsequent steps of the assembling process;

FIGS. 9 and 10 are views similar to those of FIGS. 1 and 2, showing the hood-collar assembly after its mounting on the main part of the garment.

DETAILED DESCRIPTION OF THE INVENTION

Figure 1:
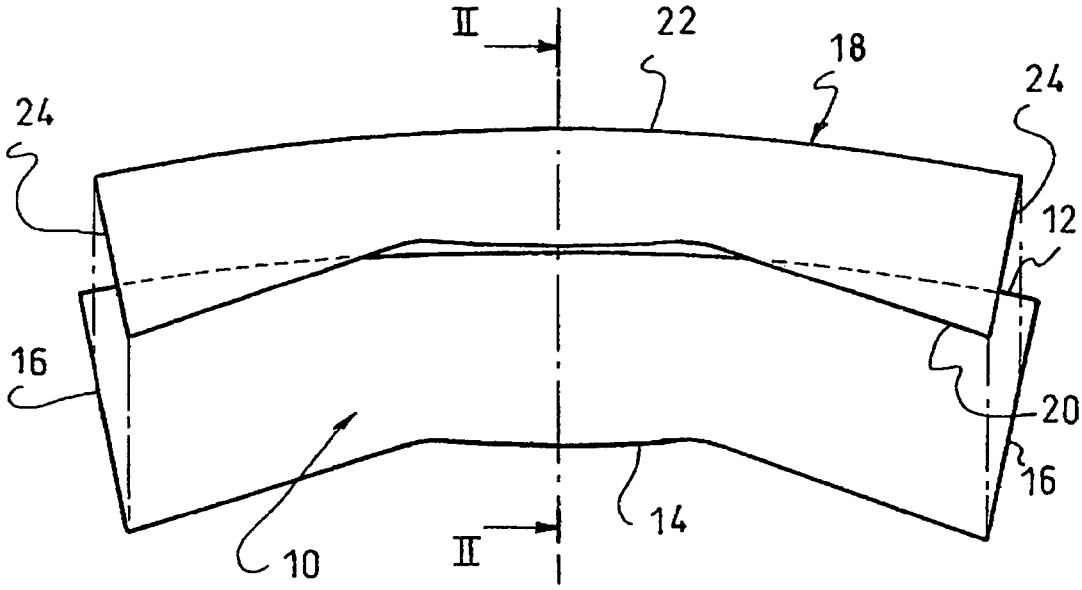
FIGS. 1 and 2 are respectively a schematic top view and a schematic partial cross-sectional view, showing a step of an assembling process for producing a hood-collar assembly according to the invention.
Figure 2:
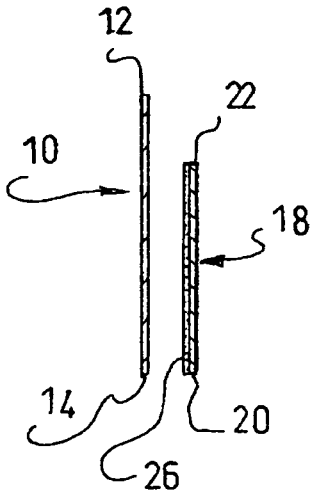

In FIGS. 1 and 2 are shown the first steps of construction of a laminated collar according to the invention.

It is first provided an outer collar layer 10 having a top edge 12, a bottom edge 14, and two lateral edges 16. In this example, the outer layer is made of a single, one-piece panel of material. Nevertheless it is contemplated that the outer layer may be made of several panels assembled together along a predetermined pattern to form the outer layer 10.

In a particular embodiment, the outer layer 10 will be made of a breathable water-resistant fabric, possibly a two or three layer laminated fabric, but any type of material suitable for garment manufacturing may be used. As will be seen hereunder, the material of the outer layer 10 will preferably be flexible, at least in the top part of the outer layer. The outer layer 10 has an external surface and an internal surface, the latter being visible in FIG. 1.

An inner collar layer is to be connected to the outer collar layer 10 in a face-to-face relationship along a-facing area. In the example shown, the inner collar layer is to be made of several panels. In FIGS. 1 and 2, a first inner panel 18 is shown which is intended to cover the internal surface of the outer layer 10 along a lower facing area. This first inner panel 18 has a bottom edge 20, a top edge 22, and two lateral edges 24. The first inner panel 18 is to be connected to the outer layer 10 so that their respective bottom and lateral edges are substantially coincident. Due to the fact that, in this embodiment, the inner layer is composed of several panels, the first inner panel 18 does not cover the entirety of the outer collar layer 10.

Therefore, the top edge 22 of the first inner collar panel is located between the outer collar layer top edge 12 and the outer collar layer bottom edge 14.

According to one aspect of the invention, the first inner panel 18, being a part of the inner collar layer, is to be connected to the outer layer 10 by adhesive bonding along an adhesion zone.

Depending on the materials making up the inner and outer layers, different adhesive bonding techniques can be used. It is within the scope of the invention that, if the materials are compatible, the layers are affixed by welding, for example ultrasonic or radio-frequency welding. But, in most cases, the adhesive bonding can be achieved through the use of an adhesive material such as glues or glue-containing compounds. Many types of glues can be used, such as, for example, polyurethane based glues. Such glues can be in the form of self-standing films or in liquid form. They can be thermo-activated glues, e.g., hot-melt glues. A glue-containing compound may be for example made of two or more films of hot-melt adhesive, possibly of different compositions to adapt to the specific materials of the inner layer on one side and of the outer layer on the other side. The gluing compound could also possibly have an interfacial layer between two adhesive films. The interfacial layer could for example be a fabric layer or a foam layer.

In the example shown, the adhesive bonding is achieved though the use of a film of thermo-activated polyurethane glue 26. As shown in FIG. 2, the film of glue is first bonded to the first inner panel 18. In this embodiment, the film of glue 26 (which defines the adhesion zone) covers substantially the entire surface of the first inner panel (which defines the lower facing zone, or the proximal facing zone), and it is substantially continuous along this whole surface. Nevertheless, it could be that the film of glue (i.e. the adhesion zone) extends only along a portion of the lower facing surface, as long as it represents a substantial portion thereof, and as long as it is not limited to a mere gluing line. Also, the film may be non-continuous, for example in the form of a portion with holes, or in the form of a web-like layer. Here again, it is desirable that a substantial portion of the inner panel be effectively adhesively bonded to the outer layer 10.

In FIGS. 3 and 4, it is shown how a hood can be assembled to the collar. The hood 28 as shown in the figures can be of any conventional type, and may be for example constructed as in the above-mentioned U.S. Pat. No. 6,654,963. As in that patent, the hood of FIGS. 2 and 3 is assembled at mid-height of the collar. Therefore, the connection zone 30 of the hood on the outer layer 10 is not near the top edge 12, nor near the bottom edge of the outer collar layer 10, but rather in between.

One possibility is to affix the hood 28 permanently directly to the collar, for example by sewing, gluing, welding, etc., directly on the external surface of the outer layer 10, as shown in FIG. 4. It is also possible to provide that the hood is affixed to the collar through non-permanent means. For example, it could be provided that a small flap be fixed on the collar (possibly permanently fixed), the hood being removably connected to the flap by a zipper, by snap buttons, by hook and loop fasteners, etc.

FIG. 4 shows a hood is sewn on the collar by a double stitched seam 32, which makes it desirable to provide means for waterproofing the stitched seams. One possibility to achieve such waterproofing is to cover the seam with a sealing tape (on the external side or on the internal side). One aspect of the invention is to omit such waterproofing tape simply by using the laminated first internal panel 18, 26 as a waterproofing means. Indeed, it is chosen that the connecting zone 30 of the hood on the collar (the connecting zone 30 being, in this embodiment, the zone where the seams 32 are located) is placed within the lower facing area of the outer layer, and therefore it is located so that the stitched seam(s) 32 is (are) covered by the first inner panel 18. More precisely, it is desirable that the stitched seam(s) is (are) located within the adhesion zone, so as to be covered by the adhesive material 26 which may guarantee the imperviousness of the seam.

Figure 5:
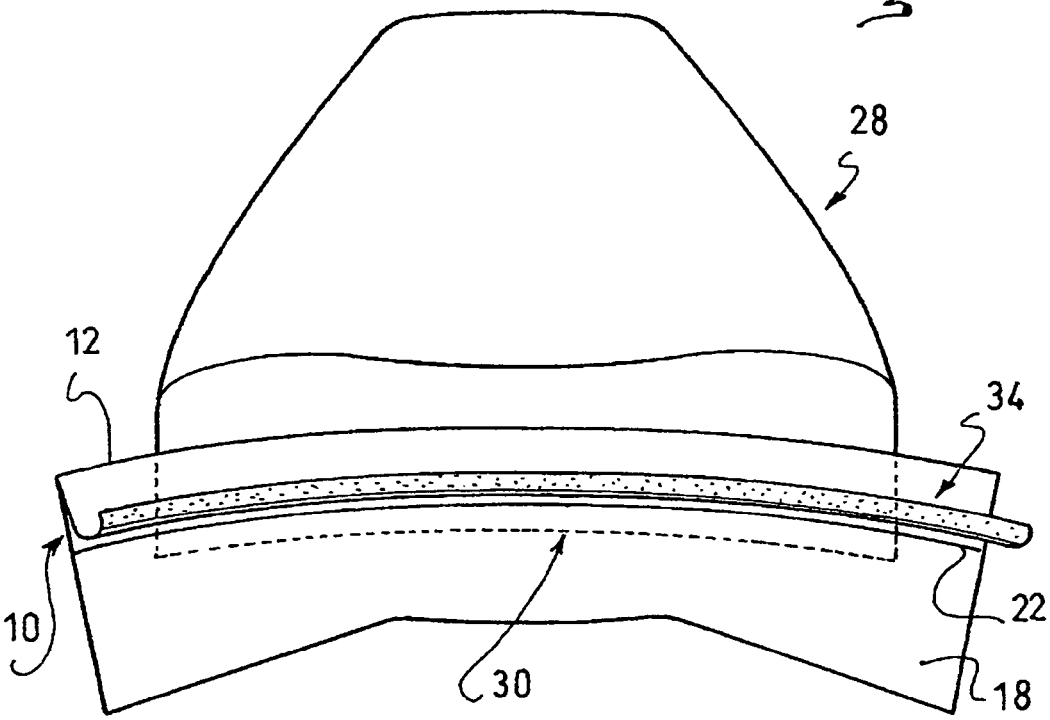
Figure 6:
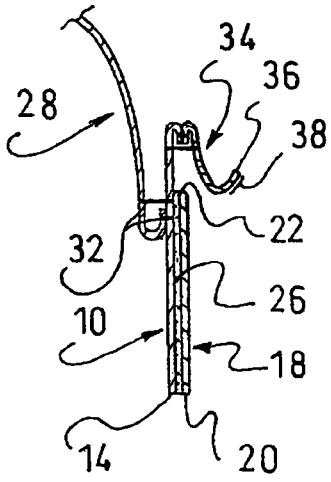

It is possible to provide that the hood 28 be fixed to the outer layer 10 before the first inner panel is adhered onto the internal surface of the outer layer. Nevertheless, in a preferred assembly process, the first inner panel 18 is first partly assembled to the outer layer 10, at least along their corresponding bottom edges 14, 20, but it is not assembled along its top edge, so as to not cover the connecting zone 30 of the hood 28 on the outer layer 10 (see FIG. 4). Such an assembly can be performed while the two layers 10, 18 are perfectly flat, which makes it very easy to achieve a perfect alignment of the corresponding bottom edges 14, 20, and hence a proper positioning of the first inner panel 18 with respect to the outer layer 10. The hood 28 is then attached to the outer layer 10 of the collar by the stitched seams 32, without being fixed directly to the first inner panel 18. Once the hood 28 is attached, the first inner panel 18 is fully adhered to the outer layer so as to cover the connecting zone 30 (as shown on FIG. 5 and 6). This final assembly step of the first inner panel is made simple by the fact that the proper positioning of the two layers 10, 18 has been ascertained by the preliminary assembly along their bottom edges.

If, as envisioned above, the hood were to be attached through a non-permanent connection via a flap which itself would be attached to the collar, then said flap may be attached as described in the above process.

According to one aspect of the invention, the upper part of the inner collar layer, i.e., the distal part of the inner collar, here made of a separate panel, i.e., a second inner panel 34, is essentially free from the outer layer 10 except at its edges. In other words, contrary to the first inner panel 18, the second inner panel 34 is not adhered along a substantial portion of its area to the outer layer 10. As shown in the illustrated embodiment (see FIGS. 8 and 10, e.g.), no additional layer is adhered to the second inner panel 34 between the second inner panel and the outer layer 10 in the distal facing zone of the collar. Basically, the upper collar panel 34 is attached to outer layer 10 in the same way that traditional jacket collars are made.

According to the preferred process of making the collar, the second inner panel 34 has a top edge, or distal edge, which is attached to the corresponding top edge 12, or distal edge, of the outer layer 10. In the example shown in FIG. 6, this attachment is made through a conventional stitched seam attachment, but other attachment means are possible (gluing, welding, etc.).

Figure 8:
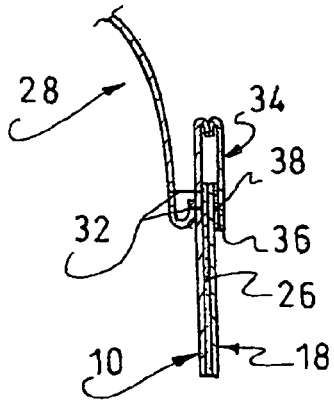
FIG. 8 is a view similar to that of FIG. 2, showing a partial cross section of the hood collar assembly.

The second inner panel 34 has also a bottom edge 36 which is also to be affixed to collar. In order for the inner collar layer (comprising in this embodiment both the first and the second inner panels) to completely cover the internal surface of the outer layer 10, it is desirable that the bottom edge 36 of the second inner panel is located below the top edge 22 of the first inner layer 18 so that the second inner panel 34 partly overlaps the first inner panel 18. In this case, the bottom part of the second inner panel 34 is fitted with a layer of hot-melt adhesive 38 for fixing on the top part of the first inner panel 18, as shown in FIG. 8.

Figure 7:
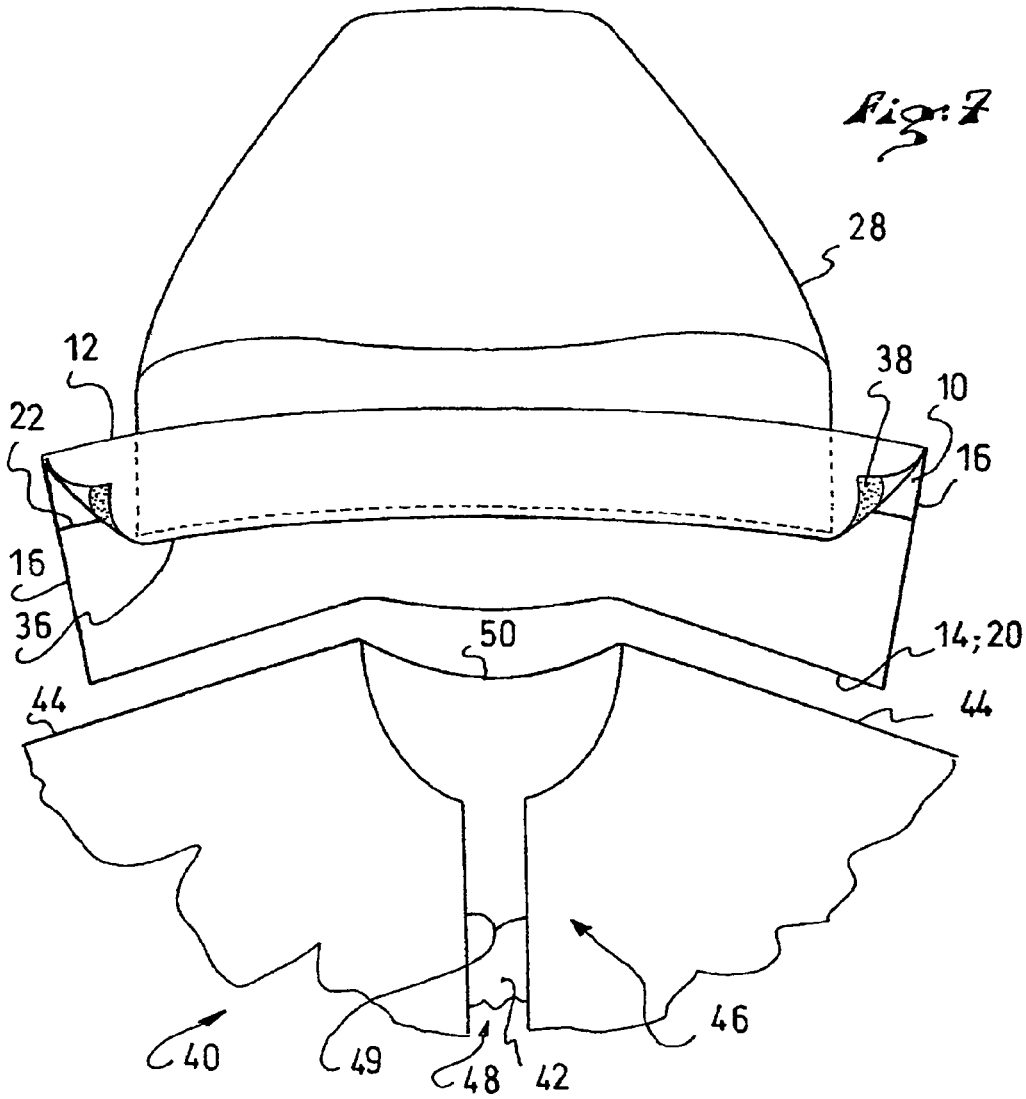
FIGS. 7 is view of the hood-collar assembly, before its mounting on the main part of a garment.

According to a particular aspect of the process, the bottom part of the second inner panel 34 is not, at this stage of the process, adhered along its whole length to the first inner panel 18. As shown in FIG. 7, the bottom edge is left non-attached near its lateral extremities, in order to allow a subsequent installation of a zipper or other slide-fastener, as described hereunder.

In FIG. 7 is also shown, in addition to the hood-collar assembly, a portion of a torso part 40 of a jacket on which the pre-assembled hood-collar assembly can be fitted. The torso part 40 has a back part 42, shoulder parts 44, and a front part 46 which is divided in two by a vertical front opening 48. The front opening 48 is therefore demarcated between two substantially vertical borders 49 of the front part of the torso part. A neckline 50 of the torso part extends from one border 49 of the front opening 48, over one shoulder part 44, across the back part 42, and back to the other border 49 of the front opening 48 over the other shoulder part 44. The neckline 50 defines a neck opening. The bottom edge 14, 20 of the collar is to be affixed to the neckline 50 along its whole length, as shown in FIGS. 9 and 10. The attachment of the hood-collar assembly may be made by any known method. In the example shown, a conventional stitched seam 52 is used, whereby the collar is attached along an attachment zone of the proximal facing zone of the collar to the torso part 40 of the jacket, the attachment zone being a lower part, i.e., a proximal part, of the proximal facing zone of the collar. The seam is shown as being made waterproof by a conventional sealing tape 54 affixed over the seam along its length. Other attachment methods could be used, such as gluing or welding. As can be seen in FIGS. 9-12, for example, the relatively rigid part of the collar, comprised of the proximal facing zone thereof, extends upwardly, i.e., distally, beyond the attachment zone of the stitched seam 52 to the stitched seam 32 of the connection zone 30 of the hood 28. That is, the hood as well as the relatively rigid proximal facing zone of the collar is spaced from the attachment zone of the stitched seam 52.

As can be seen in the drawings, the bottom edge 14, 20 of the collar has the same length as the neckline 50 of the torso part of the garment. Hence, the lateral edges 16 of the collar correspond exactly with the borders 49 of the front opening 48, so that they constitute a mere continuation of those borders 48. Therefore, the front opening 48 extends up into the collar.

The front opening 48 is to be equipped with a conventional zipper or slide-fastener. Such zipper is made of two strips 56 of material, each carrying one series of teeth or engaging elements 58. Each strip 56 of the zipper is to be affixed to one border 49 of the front opening 48. It is of course desirable that the zipper extends not only along the torso part 40 of the garment, but also up into the continuation of the opening 48 in the collar.

Figure 11:
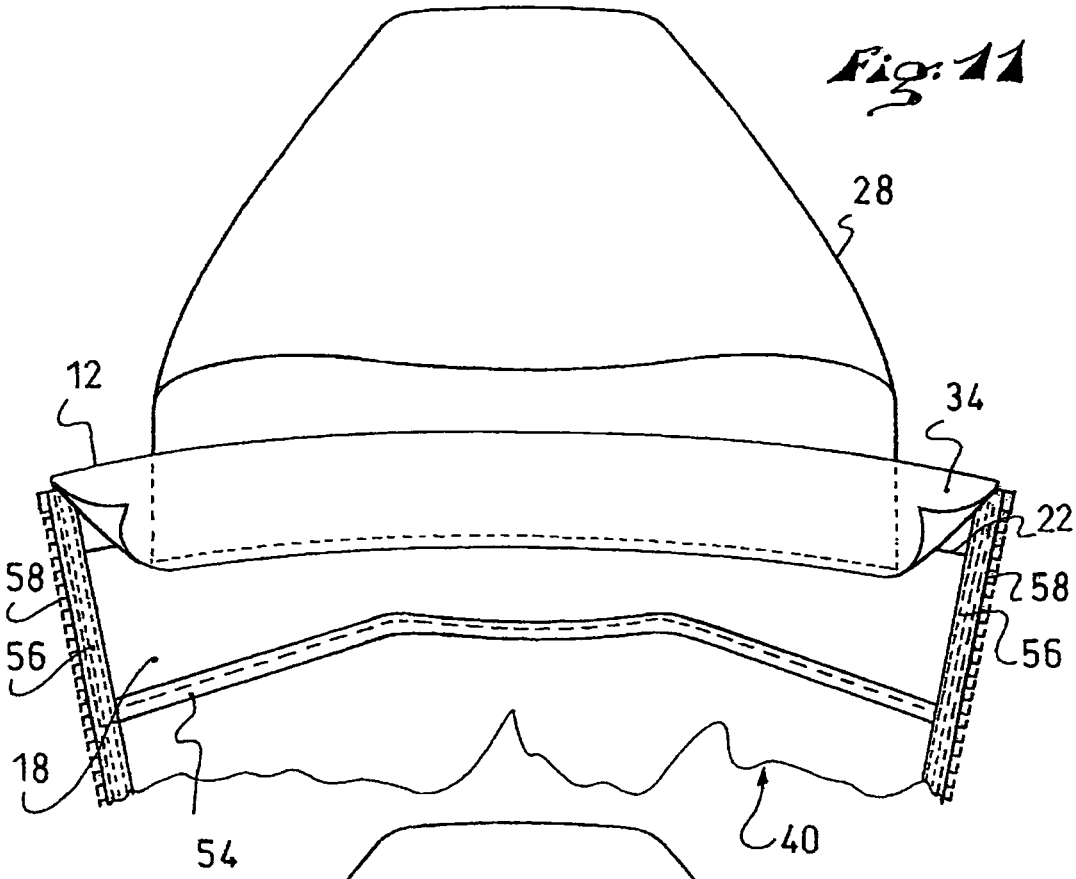
FIGS. 11 and 12 are views similar to that of FIG. 1, showing details of the installation of a zipper on the garment.
Figure 12:
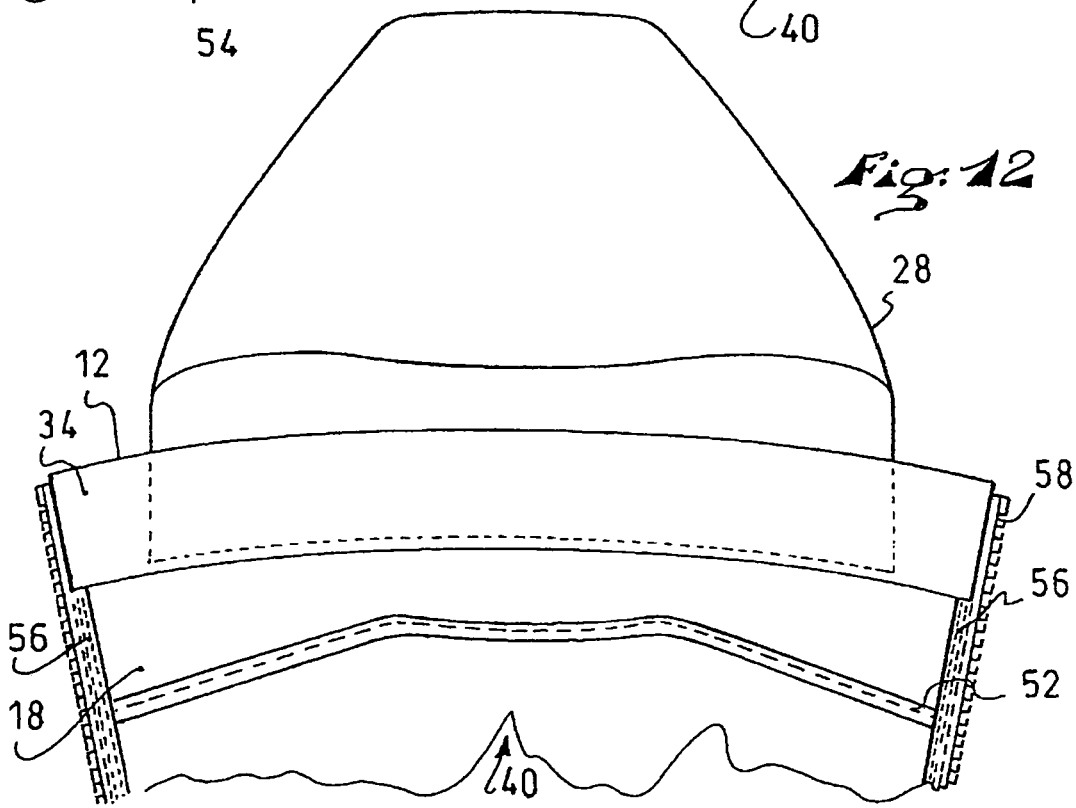

As shown in FIGS. 11 and 12, each zipper strip 56 is attached (by gluing, welding or sewing, etc.) along the borders 49 of the front opening 48, almost up to the top edge 12 of the collar. According to one aspect of the invention, the upper part of each zipper strip 56 is affixed to the internal surface of the outer collar layer 10, under the second inner panel 34. After installation of the zipper strips 56, the lateral edges of the second inner panel 34 and the lateral extremities of its bottom edge 36 are definitively attached to the rest of the collar assembly, such that the lateral edges of the second inner panel 34 cover in part the zipper strips 56, for example by sewing or by adhesive bonding.

In the above description of a particular embodiment of the invention, the inner layer of the collar is made of a single panel of material, while the inner layer is made of two panels. It is nevertheless within the scope of the invention that those layers may be made of any number of panels or sub-panels.

Similarly, the collar in the described embodiment only has two layers, but it is also within the scope of the invention that the collar may have additional layers. Those additional layers can be in the form of intermediate layers, or in the form of additional external or internal layers covering the inner or outer layers mentioned above. The additional layers may extend over the entire extent of the collar or cover only portions thereof.

The construction according to the invention primarily provides a collar having a lower, or proximal, zone where an inner layer is bonded, directly or indirectly through one or several intermediate layer(s), to an outer layer. In this lower/proximal zone, the collar has therefore a laminated structure so that it exhibits some rigidity, even though it may be constructed only using flexible materials. This relative rigidity imparts to the collar, all around the neckline of the garment, a stable shape, both comfortable and aesthetically pleasing. This relative rigidity is also very helpful when mounting the collar on the torso part of the garment, because it makes it much simpler to achieve a precise positioning of the collar with respect to the torso part. In turn, this proper positioning is a decisive factor to guarantee a smooth functioning of the zipper when the slider of the zipper crosses the junction zone between the collar and the torso part. In the lower/proximal zone, the laminated inner layer will also have the tendency to remain "flat" along the outer layer, avoiding the formations of bumps and lows, the bumps of the prior art being subject to high abrasion wear.

The collar also has an upper zone, or distal zone, where the outer and inner layers are not laminated one to the other, keeping therefore a relative higher flexibility compared to the lower zone, i.e., the proximal zone. The higher flexibility of the upper/distal zone is a guarantee of comfort by avoiding any "sharp edge" effect at the top edge of the collar, as said top edge may come in contact with the wearer's head or neck.

The dual zone construction of the collar is therefore an optimum balance of comfort and precise assembly of the garment. The dual zone construction of the collar according to the invention may be used independently of the presence of a hood attached to the collar.

Nevertheless, when such construction is used in a collar combined with a hood, it can be most advantageous to provide that the hood, as in the above described embodiment, be connected to collar, substantially at mid-height, on the lower relatively rigid zone. Indeed, this can guarantee that the hood does not distort the shape of the collar, or only to a minimal extent, which will also a beneficial effect to the looks of-the garment and to its comfort in use.

The inner panel(s) can be made of different materials. In a particular embodiment, they can have an inner surface having a comfortable feel. In some cases, the inner panel(s) could be formed at least in part by a folded over portion of the outer layer.

The invention claimed is:

1. A collar for a garment, said collar comprising:

an outer layer and an inner layer facing each other along a facing area, the facing area comprising a proximal facing zone and an distal facing zone, said proximal facing zone including an attachment zone for attaching the collar to a part of the garment;

an adhesive bond connecting the outer and inner layers along at least a substantial portion of the proximal facing zone, said adhesive bond defining an adhesion zone extending beyond said attachment zone in a direction toward the distal facing zone;

along the distal facing zone, beyond the adhesion zone, the inner and outer layers are free relative to each other except along at least a part of the periphery of the distal facing zone;

along the distal facing zone, except along at least a part of the periphery of the distal facing zone, the outer layer not being adhered to the inner layer nor to any additional layer in the distal facing zone;

the inner layer comprising:

a first inner collar panel having a top edge and a bottom edge, the first inner collar panel not extending along the distal facing zone;

a second inner collar panel extending along an upper part of the internal surface of the outer layer;

the second inner collar panel having a bottom edge overlapping the top edge of the first inner collar panel;

the bottom edge of the second inner collar panel being connected to the top edge of the first inner collar panel by adhesive bonding;

the adhesive bond connecting the first inner collar panel to the internal surface of the outer layer along a substantial part of the adhesion zone.

2. A collar according to claim 1, wherein:

the distal facing zone has a top peripheral edge corresponding to top edges of the outer and inner layers;

the top edges of the outer and inner layers are connected one to another.

3. A collar according to claim 1, further comprising:

a hood connected to an external surface of the outer layer along a connecting zone which is positioned within the proximal facing zone of the inner and outer layers, said connecting zone being distinct from said attachment zone.

4. An outerwear garment comprising a collar according to claim 1, wherein:

a bottom edge of the collar is affixed to a neckline of a torso portion of the outerwear garment.

5. A collar according to claim 1, wherein:

said collar comprises a proximal zone and distal zone, the proximal zone having a greater rigidity than the distal zone.

6. A collar according to claim 5, wherein:

the proximal zone has a laminated structure.

7. A collar according to claim 6, wherein:

the distal zone of the collar has a non-laminated structure.

8. A collar according to claim 1, further comprising:

a hood connected to an external surface of the outer layer along a connecting zone;

said connecting zone being positioned within the proximal facing zone of the inner and outer layers; and said connecting zone being spaced from the attachment zone for attaching the collar to said part of the garment.

9. A collar according to claim 8, wherein:

said connecting zone is positioned at substantially mid-height of the collar.

10. A collar according to claim 1, wherein:

the second inner panel has a bottom edge, said bottom edge of the second inner panel is positioned above the bottom edge of the first inner panel.

11. A collar for a garment, said collar comprising:

an outer layer and an inner layer facing each other along a facing area, the facing area comprising a proximal facing zone and an distal facing zone, said proximal facing zone including an attachment zone for attaching the collar to a part of the garment;

an adhesive bond connecting the outer and inner layers along at least a substantial portion of the proximal facing zone, said adhesive bond defining an adhesion zone extending beyond said attachment zone in a direction toward the distal facing zone;

along the distal facing zone, beyond the adhesion zone, the inner and outer layers being free relative to each other except along at least a part of the periphery of the distal facing zone;

along the distal facing zone, except along at least a part of the periphery of the distal facing zone, the outer layer not being adhered to the inner layer nor to any additional layer in the distal facing zone;

the inner layer comprising:

a first inner collar panel having a top edge and a bottom edge, the first inner collar panel not extending along the distal facing zone;

a second inner collar panel extending along an upper part of the internal surface of the outer layer;

the adhesive bond connecting the first inner collar panel to the internal surface of the outer layer along a substantial part of the adhesion zone;

a hood connected to an external surface of the outer layer along a connecting zone which is positioned within the proximal facing zone of the inner and outer layers, said connecting zone being distinct from said attachment zone;

the adhesion zone covering the connecting zone of the hood.

12. A collar for a garment, said garment comprising:

an outer layer and an inner layer facing each other along a facing area, the facing area comprising a proximal facing zone and an distal facing zone, said proximal facing zone including an attachment zone for attaching the collar to a part of the garment;

an adhesive bond connecting the outer and inner layers along at least a substantial portion of the proximal facing zone, said adhesive bond extending beyond said attachment zone in a direction toward the distal facing zone;

along the distal facing zone, except along at least a part of the periphery of the distal facing zone, the outer layer not being adhered to the inner layer nor to any additional layer in the distal facing zone;

the outer layer having a top edge and a bottom edge, an external surface and an internal surface;

a hood connected to the external surface of the outer layer along a connecting zone which is positioned between the top edge end the bottom edge, at a distance from both edges and spaced from the attachment zone for attaching the collar to a part of the garment;

the inner layer comprising at least a first inner collar panel having a top edge and a bottom edge, the first inner collar panel covering at least a lower part of the outer layer;

the adhesive bond connecting the first inner collar panel to the internal surface of the outer layer along a substantial part of an adhesion zone; and the adhesion zone covering the connecting zone of the hood.

13. An outerwear garment comprising a collar according to claim 12, wherein:

a bottom edge of the collar is affixed to a neckline of a torso portion of the outerwear garment.

14. A collar according to claim 12, wherein:

the top edge of the first inner collar panel is located between the outer collar layer top edge and the hood connecting zone.

15. A collar according to claim 14, wherein:

the inner collar layer further comprises a second inner collar panel covering an upper part of the internal surface of the outer collar layer.

16. A collar according to claim 15, wherein:

the second inner collar panel has a top edge which is connected to the top edge of the outer collar layer.

17. A collar for a garment, said collar comprising:

an outer layer and an inner layer facing each other along a facing area, the facing area comprising a proximal facing zone and an distal facing zone;

the outer and inner layers being connected one to another by adhesive bonding along at least a substantial portion of the proximal facing zone;

along the distal facing zone, the inner and outer layers are free relative to each other except along at least a part of the periphery of the distal facing zone;

the outer collar layer having a top edge and a bottom edge, an external surface and an internal surface;

a hood being connected to the external surface of the outer layer along a connecting zone which is positioned between the top edge end the bottom edge, at a distance from both edges;

an inner collar layer comprising at least a first inner collar panel having a top edge and a bottom edge, the first inner collar panel covering at least a lower part of the outer collar layer;

the first inner collar panel being adhesively bonded to the internal surface of the outer collar layer along a substantial part of an adhesion zone;

the adhesion zone covering the connecting zone of the hood;

the top edge of the first inner collar panel being located between the outer collar layer top edge and the hood connecting zone;

the inner collar layer further comprising a second inner collar panel covering an upper part of the internal surface of the outer collar layer;

the second inner collar panel having a bottom edge overlying the top edge of the first inner collar panel.

18. A collar according to claim 17, wherein:

the bottom edge of the second inner collar panel is connected to the top edge of the first inner collar panel by adhesive bonding.

19. A collar for a garment, said collar comprising:

an outer layer and an inner layer facing each other along a facing area, the facing area comprising a proximal facing zone and an distal facing zone, said proximal facing zone including an attachment zone for attaching the collar to a part of the garment;

the proximal facing zone having a greater rigidity than the distal facing zone;

an adhesive bond connecting the outer and inner layers along at least a substantial portion of the proximal facing zone, said adhesive bond defining an adhesion zone extending beyond said attachment zone in a direction toward the distal facing zone;

along the distal facing zone, beyond the adhesion zone, the inner and outer layers being free relative to each other except along at least a part of the periphery of the distal facing zone;

along the distal facing zone, except along at least a part of the periphery of the distal facing zone, the outer layer not being adhered to the inner layer nor to any additional layer in the distal facing zone;

the inner layer comprising:

a first inner collar panel having a top edge and a bottom edge, the first inner collar panel not extending along the distal facing zone;

a second inner collar panel extending along an upper part of the internal surface of the outer layer;

the adhesive bond connecting the first inner collar panel to the internal surface of the outer layer along a substantial part of the adhesion zone;

a hood being connected to the collar along a connecting zone which is positioned in the proximal zone of the collar and spaced from the attachment zone for attaching the collar to a part of the garment.

20. A collar for a garment, said collar comprising:

an outer layer and an inner layer facing each other along a facing area, the facing area comprising a proximal facing zone and an distal facing zone, said proximal facing zone including an attachment zone for attaching the collar to a part of the garment;

an adhesive bond connecting the outer and inner layers along at least a substantial portion of the proximal facing zone, said adhesive bond defining an adhesion zone extending beyond said attachment zone in a direction toward the distal facing zone;

along the distal facing zone, beyond the adhesion zone, the inner and outer layers being free relative to each other except along at least a part of the periphery of the distal facing zone;

along the distal facing zone, except along at least a part of the periphery of the distal facing zone, the outer layer not being adhered to the inner layer nor to any additional layer in the distal facing zone;

the inner layer comprising:

a first inner collar panel having a top edge and a bottom edge, the first inner collar panel not extending along the distal facing zone;

a second inner collar panel extending along an upper part of the internal surface of the outer layer;

the adhesive bond connecting the first inner collar panel to the internal surface of the outer layer along a substantial part of the adhesion zone;

the adhesive bonding along at least a substantial portion of the proximal facing zone of the outer and inner layers comprising an adhesive bonding along substantially the entirety of the proximal facing zone between two lateral edges of the proximal facing zone of the inner and outer layers.

21. A collar for a garment, said collar comprising:

an outer layer and an inner layer facing each other along a facing area, the facing area comprising a proximal facing zone and an distal facing zone, said proximal facing zone including an attachment zone for attaching the collar to a part of the garment;

an adhesive bond connecting the outer and inner layers along at least a substantial portion of the proximal facing zone, said adhesive bond defining an adhesion zone extending beyond said attachment zone in a direction toward the distal facing zone;

along the distal facing zone, beyond the adhesion zone, the inner and outer layers being free relative to each other except along at least a part of the periphery of the distal facing zone;

along the distal facing zone, except along at least a part of the periphery of the distal facing zone, the outer layer not being adhered to the inner layer nor to any additional layer in the distal facing zone;

the inner layer comprising:

a first inner collar panel having a top edge and a bottom edge, the first inner collar panel not extending along the distal facing zone;

a second inner collar panel extending along an upper part of the internal surface of the outer layer;

the adhesive bond connecting the first inner collar panel to the internal surface of the outer layer along a substantial part of the adhesion zone;

the adhesive bonding along at least a substantial portion of the proximal facing zone of the outer and inner layers comprising a single continuous adhesive bonding between two lateral edges of the proximal facing zone of the inner and outer layers.

22. A hood-collar assembly for a garment, comprising:

an outer collar layer having a top edge and a bottom edge, an external surface and an internal surface;

a hood connected to the external surface of the outer layer along a connecting zone which is positioned between the top edge end the bottom edge, at a distance from both edges;

an inner collar layer comprising at least a first inner collar panel having a top edge and a bottom edge, the first inner collar panel covering at least a lower part of the outer collar layer;

the first inner collar panel being adhesively bonded to the internal surface of the outer collar layer along a substantial part of an adhesion zone;

the adhesion zone covering the connecting zone of the hood;

the top edge of the first inner collar panel is located between the outer collar layer top edge and the hood connecting zone;

the inner collar layer further comprising a second inner collar panel covering an upper part of the internal surface of the outer collar layer;

the second inner collar panel having a top edge which is connected to the top edge of the outer collar layer;

the second inner collar panel having a bottom edge which overlies the top edge of the first inner collar panel.

23. A hood-collar assembly according to claim 22, wherein:

the bottom edge of the second inner collar panel is connected to the top edge of the first inner collar panel by adhesive bonding.

24. A collar for a garment, said collar comprising:

an outer layer and an inner layer facing each other along a facing area, the facing area comprising a proximal facing zone and an distal facing zone;

the collar having a height extending between a distal edge and a proximal edge of the collar;

the outer and inner layers being connected one to another by adhesive bonding along at least a substantial portion of the proximal facing zone and extending from the proximal edge of the collar in a direction toward the distal edge of the collar to at least mid-height of the collar;

the outer and inner layers being connected together at the distal edge periphery of the collar;

the inner layer comprising a first inner panel and a second inner panel;

along the proximal facing zone, the first inner panel of the inner layer is interposed between the second inner panel and the outer layer;

along the distal facing zone, between the proximal facing zone and the distal edge, the second inner panel and the outer layer being free relative to each other, the first inner panel not being interposed between the second inner panel and the outer layer in the distal facing zone.

25. A collar for a garment, said collar comprising:

an outer layer and an inner layer facing each other along a facing area, the facing area comprising a proximal facing zone and an distal facing zone, said proximal facing zone including an attachment zone for attaching the collar to a part of the garment;

the outer and inner layers being connected one to another by adhesive bonding along at least a substantial portion of the proximal facing zone, said adhesive bonding extending beyond said attachment zone in a direction toward the distal facing zone;

the adhesive bonding along at least a substantial portion of the proximal facing zone of the outer and inner layers comprising an adhesive bonding along substantially the entirety of the proximal facing zone between two lateral edges of the proximal facing zone of the inner and outer layers;

the distal facing zone having a top peripheral edge corresponding to top edges of the outer and inner layers;

the top edges of the outer and inner layers being connected one to another;

along the distal facing zone, the inner and outer layers are free relative to each other except along at least a part of the periphery of the distal facing zone;

along the distal facing zone, except along at least a part of the periphery of the distal facing zone, the outer layer not being adhered to the inner layer nor to any additional layer in the distal facing zone;

the inner collar layer comprising:

a first inner collar panel having a top edge and a bottom edge, the outer layer extending upwardly beyond the top edge of the first inner collar panel;

a second inner collar panel covering an upper part of the internal surface of the outer collar layer;

the first inner collar panel being adhesively bonded to the internal surface of the outer collar layer along a substantial part of an adhesion zone.

26. A collar according to claim 25, wherein:

the adhesive bonding along at least a substantial portion of the proximal facing zone of the outer and inner layers comprises a single continuous adhesive bonding between two lateral edges of the proximal facing zone of the inner and outer layers.

* * * * *